United States Patent [19]

Capuano

[11] Patent Number: 4,838,727

[45] Date of Patent: Jun. 13, 1989

[54] SLOTTED DRAIN CONDUIT

[75] Inventor: Terry D. Capuano, Moreland Hills, Ohio

[73] Assignee: ACO Polymer Products, Inc., Chagrin Falls, Ohio

[21] Appl. No.: 212,667

[22] Filed: Jun. 28, 1988

[51] Int. Cl.[4] ..... E01C 11/22

[52] U.S. Cl. ..... 404/2; 404/4

[58] Field of Search ..... 404/2–5; 405/40, 43, 44, 47, 48, 118, 119, 126; 285/330; 52/169.5

[56] References Cited

U.S. PATENT DOCUMENTS

| | | | |
|---|---|---|---|
| 469,044 | 2/1892 | Jungbluth | 404/2 |
| 494,620 | 4/1893 | Bedgood | 404/2 |
| 733,169 | 7/1903 | Devonshire | 405/119 X |
| 777,524 | 12/1904 | Lockwood | 404/3 |
| 1,362,952 | 12/1920 | McQueary | 404/2 |
| 2,436,593 | 2/1948 | Moselowitz | 404/4 |
| 2,649,720 | 8/1953 | Heltzel | 404/2 |
| 3,225,545 | 12/1965 | Flegel | 404/2 |
| 3,606,395 | 9/1971 | Salerno et al. | 285/330 X |
| 3,876,322 | 4/1975 | Deason | 404/2 |
| 3,898,778 | 8/1975 | Erickson et al. | 405/48 X |
| 3,990,727 | 11/1976 | Gallagher | 285/330 X |
| 4,105,353 | 8/1978 | Bork et al. | 404/2 |
| 4,560,302 | 12/1985 | Karbstein | 404/4 |
| 4,621,939 | 11/1986 | Thomann et al. | 404/4 |
| 4,630,962 | 12/1986 | Thomann et al. | 404/2 |
| 4,641,993 | 2/1987 | Hahne | 404/4 |
| 4,787,773 | 11/1988 | Kehler | 405/118 |

FOREIGN PATENT DOCUMENTS

| | | | |
|---|---|---|---|
| 3243210 | 8/1983 | Fed. Rep. of Germany | 404/2 |
| 20789 | of 1904 | United Kingdom | 404/2 |
| 291893 | 7/1928 | United Kingdom . | |
| 2124277 | 2/1984 | United Kingdom | 405/126 |

*Primary Examiner*—Jerome W. Massie IV
*Assistant Examiner*—Matthew Smith
*Attorney, Agent, or Firm*—Beveridge, DeGrandi & Weilacher

[57] ABSTRACT

A one-piece slotted conduit having a thin inner body section and an encompassing frame structure. The encompassing frame structure having specially designed recesses formed in it to ensure maximum conduit strength and an economic use of material. The slotted conduit also including male/female interconnecting ends which ensure easy and accurate alignment of a plurality of conduits in an interconnected system.

20 Claims, 2 Drawing Sheets

SLOTTED DRAIN CONDUIT

BACKGROUND OF THE INVENTION

1. Field of Invention

This invention relates to a slotted drain conduit. More particularly, this invention relates to an interconnectable, one piece slotted drain conduit.

2. Description of the Prior Art

Slotted drain channels are known, per se, and are used to redirect fluid flow in various environments such as roadways, stable floors, industries, and the like.

For example U.S. Pat. No. 1,362,952 to McQueary reveals a metallic culvert which is used to redirect fluid flow from one side of a roadway to the other. Culverts like that of McQueary, since they are used strictly to direct fluid flow across a roadway, are usually made non-interconnectable and of the same width as the roadway into which they are embedded. Moreover, the use of a metallic liner within a concrete anchoring structure often proves to be entirely unsatisfactory. Especially in an area where freezing and thawing takes place, water seeping between the liner and the cement tends to result in separation of the liner from its surrounding concrete anchoring structure. Also, the difference in thermal expansion between the liner and the anchoring concrete structure tends to create cracking in the concrete anchoring surface. In addition, metallic parts rust due to water and salts.

U.S. Pat. No. 469,044 to Jungbluth shows a metallic liner embedded in a concrete or clay anchoring structure. Jungbluth thus is subject to many of the same problems as is the structure of McQueary.

U.S. Pat. No. 494,620 to Bedgood shows a gutter tile which includes a slotted conduit and, for extra strength, a series of metallic ties embedded therein. In forming a tile such as that of Bedgood a large amount of material is utilized to ensure that the metallic ties are properly embedded. Thus, in providing a somewhat strengthened product Bedgood has sacrificed economy in both manufacturing and material costs.

SUMMARY OF THE INVENTION

It is an object of the invention to avoid the shortcomings of the prior art and have a product which achieves high strength with a minimum of manufacturing and material costs. More particularly some of the objects of the invention include:

A. Providing a drainage conduit that is adapted to be easily assembled with (and disassembled from) conduits of similar design.

B. Providing a drainage conduit that makes economical use of materials.

C. Providing a drainage conduit that is of a high strength and is durable in all weather conditions and over a long period of time and chemically resistant to salts, animal wastes and other corrosive materials.

D. Providing a drainage conduit that is easy to maintain and easy to clean.

E. Providing a drainage conduit which, when interconnected with another, avoids shifting of one conduit with respect to the other.

F. Providing a drainage conduit which achieves the utmost in safety.

It is thus an object of the invention to provide a drainage conduit which represents, among other, an improvement in each of the above noted categories A–F.

A preferred embodiment of the invention includes a one piece slotted drain conduit made of polymer concrete. Other materials are also possible with those materials preferably being non-porous, chemical resistent to corrosive elements such as salt and of a strength comparable to that of a polymer concrete. For some situations it might also be possible to use a concrete having a cement such as Portland cement. It is recognized, though, that in use of a cement such as Portland cement much thicker sections would be necessary to provide the same strength as polymer concrete would provide. Also, cement such as Portland cement would not be as smooth or chemically resistent as polymer concrete.

The invention also represents a slotted drain conduit which is complete in and of itself and therefore has no separate components. This feature makes for easier and quicker assembly of a plurality of the conduits into an interconnected system.

Moreover, the invention includes male/female interconnecting ends which are formed so that one slotted conduit can be easily connected with another and, in connecting one with the other, the assembler is assured that a smooth conduit surface is provided at the interconnection point. Using individual sections also allows large radii to be constructed using standard, straight pieces. In addition, the female interconnecting end is formed with a tab that is positioned along the external periphery of a bore. The bore is adapted to receive a projecting member positioned at the male end of a slotted conduit. The projecting member includes a keyhole which forms part of its exterior surface. A notch is also formed in the projecting member. The notch is essentially the same width as the longitudinally extended slot in the slotted conduit. The tab in the female interconnecting end and the notch and keyhole of the projecting member are arranged such that when a tab of one slotted conduit is inserted into the keyhole of another slotted conduit the slot of each conduit is assuredly lined up. Hence, in assembling a plurality of the slotted conduits, the assembler is not delayed in determining whether one conduit slot is perfectly lined up with the slot of an adjacent conduit. This design also keeps the slots straight when the channels are encased in concrete.

The invention also provides for easy assembly in that there is provided a weakened area in a lower portion of one end of the slotted conduit. This weakened area is not evident on the inside of the channel, where it would interfere with the channel flow characteristics. The weakened portion is designed to accept standard drain piping. Furthermore, the weakened area is designed to be easily knocked out by the assembler when it is desired to connect to the slotted conduit a vertical or transverse drainage pipe. Once the weakened area is knocked out, there is formed a hole which is sized to accept standard drain pipes (i.e. a hole with a 4 inch internal diameter). As each conduit has this capability, the assembler need not worry about specific positioning of specific types of slotted conduits when interconnecting a series of conduits. Furthermore, the assembler need not have to calculate, when ordering a shipment of conduits, the specific number of conduits capable of receiving transverse drain pipes.

As noted in the foregoing, a preferred embodiment of the invention utilizes a concrete which is essentially non-porous and of high strength. A polymer concrete has proven suitable for the purposes of the invention. Polymer concrete is a mixture of a polymer resin and mineral fillers. A polymer concrete which has proven suitable in the present invention is formed of a polyester resin with a quartz aggregate. The mixture rate of the polymer to aggregate is preferably within the range of about 1/5 to 1/12. Preferably, the concrete mixture is formed of either polyester, vinyl or epoxy resin in combination with silica gravel ($SiO_2$) or Calcium Carbonate ($CaCo_3$). In some instances it is also preferable to include certain filler materials commonly associated with concrete production.

The polymer concrete material is essentially nonporous in that it has a water absorption rate of 0.1% and thus cracking by expanding ice is not a problem. Also, polymer concrete is virtually immune from chemical reactions with corrosive material such as salt water. In addition polymer concrete is free from the deterioration effects of the elements. Since polymer concrete is for the most part more expensive than most other types of concrete, it is essential that the material be used in an economical manner.

The invention is structured so as to achieve high strength with a minimum of material use. The invention, in achieving this advantage, includes an inner body section which is relatively thin in cross-section. Encompassing portions of the inner body section is an external frame structure. This frame structure includes two horizontal longitudinally extending frame sections which are positioned along an upper portion of the inner body section and are integrally secured therewith. An integrally secure system is achieved by molding the slotted conduit as a single unit. However, it is possible that a secure system can be achieved in other ways such as by using adhesive to join the two separate components together. The upper horizontal frame structures have edges spaced apart from one another so as to form the slot in the drain conduit parallel to the main axis of the conduit. One manner in which economy in material use is achieved is in the forming of specifically shaped recesses between the underside of each horizontal upper frame section and the exterior surface of a portion of the inner body section. The recesses are positioned and shaped so as to minimize the use of the more expensive concrete material and yet provide a structure which, when in functional position, is high in strength.

The area between the upper horizontal frame structures and the exterior surface of the inner body section allows concrete to enter, thus, strengthening the total system. The polymer concrete drain channel acts as a smooth, lost form to produce a drain system using standard, inexpensive concrete.

To even further minimize the use of the more expensive concrete material, rib members are strategically located along the length of the slotted conduit. The ribs, in addition to helping anchor the slotted conduit against longitudinal forces, act to distribute forces in a manner which allows for a very thin inner body section. The ribs are positioned such that when a force is downwardly exerted on the upper surface of the slotted conduit the downward forces are transferred to the opposite side of the slotted conduit and along the entire length of the slotted conduit. These ribs are oriented perpendicularly to the slot in the drain conduit.

The external frame structure also includes a pair of lower horizontal frame sections. Each lower horizontal frame section extends inwardly from a respective end of the slotted conduit. These lower horizontal frame sections, acting in conjuncture with the other frame sections and the material encompassing the slotted conduit, help to ensure that the ends of each slotted conduit are firmly compressed together. In addition, upward forces at the interconnecting ends of the slotted conduit are distributed throughout the frame structure such that movement of one end with respect to the other is prevented. Furthermore, one of the lower horizontal frame sections is included with the weakened area which provides the knock out section. This positioning of the lower horizontal frame section ensures that any forces on a vertically extending drain pipe will be distributed throughout the entire frame structure of the slotted conduit.

The invention is especially suited for avoiding any shifting or rotation between one slotted conduit and an adjacent slotted conduit. The male/female interconnecting ends are well suited for preventing any transverse shifting at the adjacent conduit ends. Additionally, in a situation where the slotted conduit is essentially cylindrical in shape the keyhole and tab arrangement prevent any rotation between adjacent ends of the slotted conduits. The rib members and the end frame sections of the external frame structure provide between them a series of longitudinally positioned recesses which are well suited to prevent longitudinal movement between adjacent slotted conduits. The lower horizontal frame sections also assist in preventing displacement between adjacent slotted conduits. That is, the shape of the recesses positioned under the horizontal upper frame sections and above the lower horizontal frame sections is such that rotation of the slotted conduits is prevented.

The invention is also well suited for easy maintenance and cleaning as the keyhole tab arrangement ensures that the slots of each conduit are aligned. A cleaning paddle or the like can be easily passed along the entire length of a plurality of interconnected slotted conduits without being disrupted. Furthermore, in utilizing a concrete, such as polymer concrete, it is assured that the channel surface is very smooth so that the water flow is improved. Further, because the channel surface is smooth, bacteria growth is not a problem. Also, the smooth channel surface provided by the polymer concrete tends to be self cleaning and since polymer concrete does not absorb moisture it is not damaged by freezing and thawing.

Significant safety advantages are also achieved by the present invention. For instance, the invention is much lighter than most other drain conduits, due not only to its use of lighter material but also to its novel structural arrangement. The lightness of the present invention in combination with its ease of assembly lowers the possibility of workman being injured while assembling a series of conduits. Workman will find it easier to shift the lighter conduit when it is necessary to shift for alignment purposes. Additionally, since the present invention is self aligning the requirement for alignment is made easier and thus less lifting and shifting of the conduits is required.

An additional safety feature of the present invention is found in the unitary nature of each slotted conduit which means that there are no components to be torn loose. Since there are no components to be torn loose there is not a problem with components of the slotted conduit being hazardously placed in traffic. Moreover, there are no grates that can be stolen or removed by vandals.

Additionally, a preferred embodiment of the invention has the width of the slot dimensioned such that bicycle tires, wheelchair tires or the like will not slip through the slot and into the channel.

BRIEF DESCRIPTION OF THE DRAWINGS

Further details of the invention are explained below and are illustrated in the accompanying drawings in which.

DETAILED DESCRIPTION OF THE DRAWINGS

Figure 1:
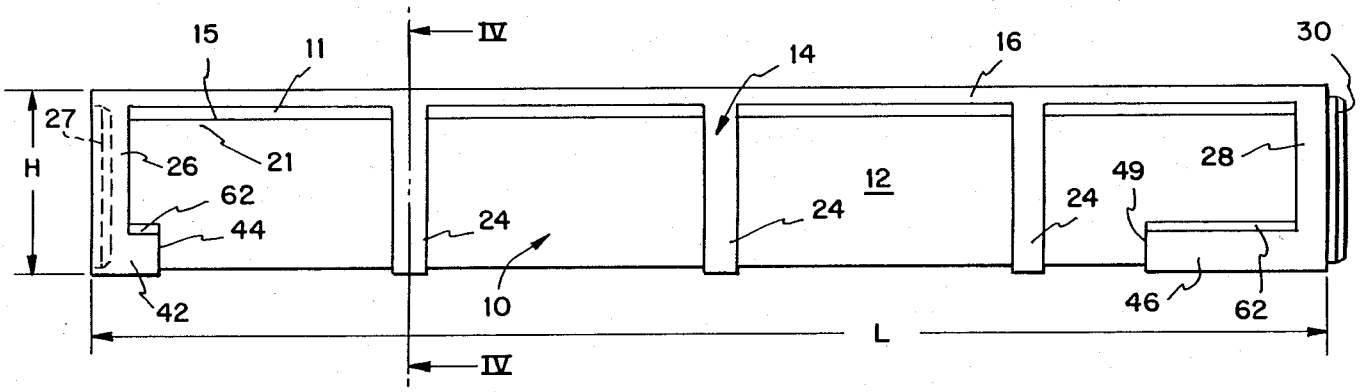
FIG. 1 represents a side view of a preferred embodiment of the invention.
Figure 2:
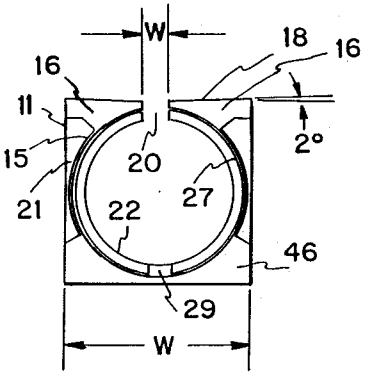
FIG. 2 represents an end view of that which is shown in FIG. 1.
Figure 4:
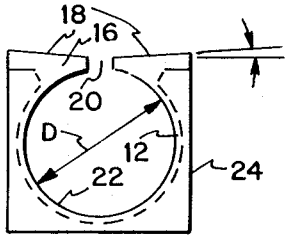
FIG. 4 illustrates a cross-sectional view taken along the line IV—IV FIG. 1.

FIG. 1 shows a side view of a slotted conduit 10 which has inner body section 12 and external frame structure 14. The external frame structure 14 includes a pair of horizontal upper frame sections 16 which extend longitudinally along the length of the slotted conduit. The upper horizontal frame sections, as best illustrated in FIGS. 2 and 4, are integrally formed with, or attached to, the upper portion of the inner body section 12. The upper surface 18 of each of the upper horizontal frame sections 16 incline inwardly so as to direct fluid flow into the slot 20 and eventually into the channel interior 22. The slot 20 extends along the entire length of conduit 10 and preferably has a width less than two inches and more preferably a width of about ¾ of an inch. The incline of the upper surface 18 of upper horizontal surfaces 16 is preferably less than 5 degrees and even more preferably about 2 degrees. In certain situations, it is possible to form the upper surface 18 of each of the horizontal sections 16 without an incline. The average thickness of the horizontal sections 16 is preferably about equal to the thickness of the inner body section 12.

The inner body 12 preferably has a wall thickness which is about 10% to 20% of the internal diameter D (FIG. 4) of the channel defined by the interior surface of the inner body 12.

The external frame structure 14 includes rib members 24. One end of each of the rib members 24 is integrally secured to an exterior side of one of the horizontal upper frame sections 16. The corresponding opposite end of each of the rib members 24 is integrally secured to the other of the upper horizontal frame sections.

The longitudinal length L of the slotted conduit is dependent on the slotted conduits desired use. However, the length of the conduit in the present invention is of a length which will ensure easily handling. For instance, in one preferred embodiment the length L is about three feet, the height H is about one-half of a foot and the width W is also about one-half of a foot. An arrangement of this sort assists in achieving a slotted conduit with a weight less than 50 lbs. Moreover, the internal diameter D (FIG. 4) of the slotted conduit preferably ranges from about two inches to two feet.

As shown in FIG. 4, the rib members 24 can be integrally molded with the inner body section 12. Other alternatives, however, are available, such as forming the external frame structure and inner body sections as separate components and then joining them together to form a unitary slotted conduit. The ribs provide vertical reinforcement and are positioned essentially tangent to the outside diameter of the inner body section to which they are attached.

The number of rib 24 is variable depending on the environment in which the conduit is to be used. For example, if the conduit is expected to be subjected to heavy downward loads an increase in the number of rib members 24 would be expected. On the other hand, if the conduit is expected not to be subjected to heavy loads, the number of rib members can be diminished. Preferably, the rib members 24 are spaced approximately twelve inches apart along the length of the conduit. The thickness of the rib member is also variable depending upon the expected loads. It should be noted, though, that in most situations the structural arrangement of the present invention allows for the use of ribs that are of minimal thickness and width.

The rib members extend transversely away from the horizontal frame sections and are squared at the bottom to provide secure seating during placement of the channels.

FIG. 4 shows, for a preferred embodiment, the thickness of both the inner body section 12 and the surrounding rib member 24. The thickness of the inner body section 12 is kept minimal due to the external frame structure's support. Thus, the arrangement allows for a conduit which is high in strength and yet is relatively inexpensive in material cost. In a preferred embodiment the ribs are two times as wide in the longitudinal direction than the thickness of the inner body section 12.

In addition to the rib members 24, the external frame structure 14 includes female end frame section 26. Female end frame section 26 is positioned at one of the ends of the slotted conduit and is arranged so as to surround the end of the inner body section in a manner much like that of the rib members 24. A bore 27 is formed longitudinally in the female end frame section 26. The bore shares a common axis with the channel 22. The longitudinally extending surface of the female end frame section, which helps to define the bore, has a cross-sectional free area which is greater than that of the channel section. For a preferred embodiment, where the channel is circular in cross-section, the bore has a diameter which is greater than that of the channel but less than that of the external surface of the cylindrically shaped inner body section 12.

Tab 29 is formed in the female end frame section as shown in FIG. 2. The tab is positioned in the area of surface defining the bore in the female end frame section. Preferably the tab is positioned diametrically opposite to the conduit's slot location. Other variations in position are also within the scope of the invention.

At the other end of the conduit 10 there is shown male end frame section 28. The male end frame section, like its female counterpart, is integrally joined with the two upper horizontal frame sections and the exterior of the inner body section. Extending outwardly from the male end frame section 28 in a direction away from the female end of the conduit, is projection member 30. In a preferred embodiment both the projection member 30 and the bore in the female end frame section 26 are made in stepped fashion.

Projection member 30 includes keyhole 32 formed in cylindrical element 34. The exterior surface of the cylindrical element has a cross-sectional area which is only slightly less than that of the bore in the female end frame section 26; whereby, when a projection member of one slotted conduit is inserted into the bore of an adjacent conduit, a tight fit is achieved. Other locations of the keyhole, notch and tab are possible as will be more clearly explained hereafter. To enable the projection member 30 to be given adequate thickness the male end frame section should be made about ⅜ inches larger than internal diameter D of the slotted conduit.

The tab 29 of one conduit is adapted to fit snugly within a keyhole 32 of another conduit when the projection member of one conduit is inserted into the bore in an adjacent conduit. The keyhole 32 is positioned on the projection member 30 such that when tab 29 of an adjacent conduit is inserted into the keyhole 32 the notch in the projection member and the slots of the two interconnected conduits are all in alignment. It is possible for the tab and keyhole to be positioned in different areas of the respective conduits ends so long as when the tab is inserted in the keyhole the notch and slots of the interconnected conduits become aligned.

Lower longitudinal female section 42, best illustrated in FIG. 1, has a first end integrally attached to the female end frame section 26. Its other end 44 extends out from the female end frame section 26 and towards the male end frame section 28. The distance which the lower longitudinal female section 42 extends outwardly is somewhat variable and preferably the non-integrally attached end does not extend completely out to the closest rib member 24. In a preferred embodiment the lower longitudinal female frame section 42 extends one to three inches towards the male end frame section.

Figure 3:
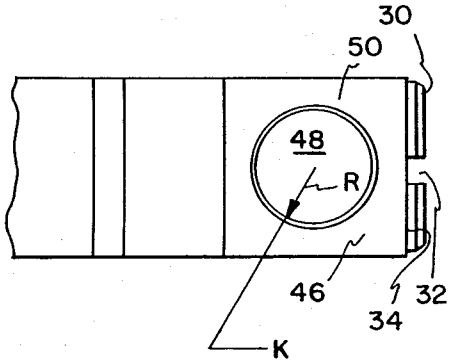
FIG. 3 illustrates a bottom view of a portion of that which is shown in FIG. 1.

Similarly, lower longitudinal male section 46 has a first end integrally secured to male end frame section 28 and a second end 49 extending a distance away from the male end frame section and towards the female end frame section 26. The end 49 of the lower longitudinal male section 46 preferably lies between an adjacent rib member 24 and the male end frame section 28. The lower longitudinal male frame section 46 is shown in FIG. 1 to be longer than the corresponding lower longitudinal female frame section 42. The reason for the difference in length is that a recessed frame portion 48 (FIG. 3) is formed in the lower longitudinal frame section 46. The circumference or periphery 50 of the recessed frame portion 48 constitutes a weakened area which an assembler can knock or punch out. A radius R of two inches has proven suitable for the purposes of the invention. The recessed frame portion is thus easily removed so as to allow for an opening to be created into which the end of a vertical drain pipe (not shown) can be inserted. In a preferred embodiment the recessed frame portion can be formed by having a recess extend all the way through the lower longitudinal male frame section 46 and partially into the surface of the underlying inner body section 12. In a preferred embodiment the recess extends into the inner body section such that the inner body section in the knock-out area has a thickness of less than about ⅜ of an inch.

Figure 5:
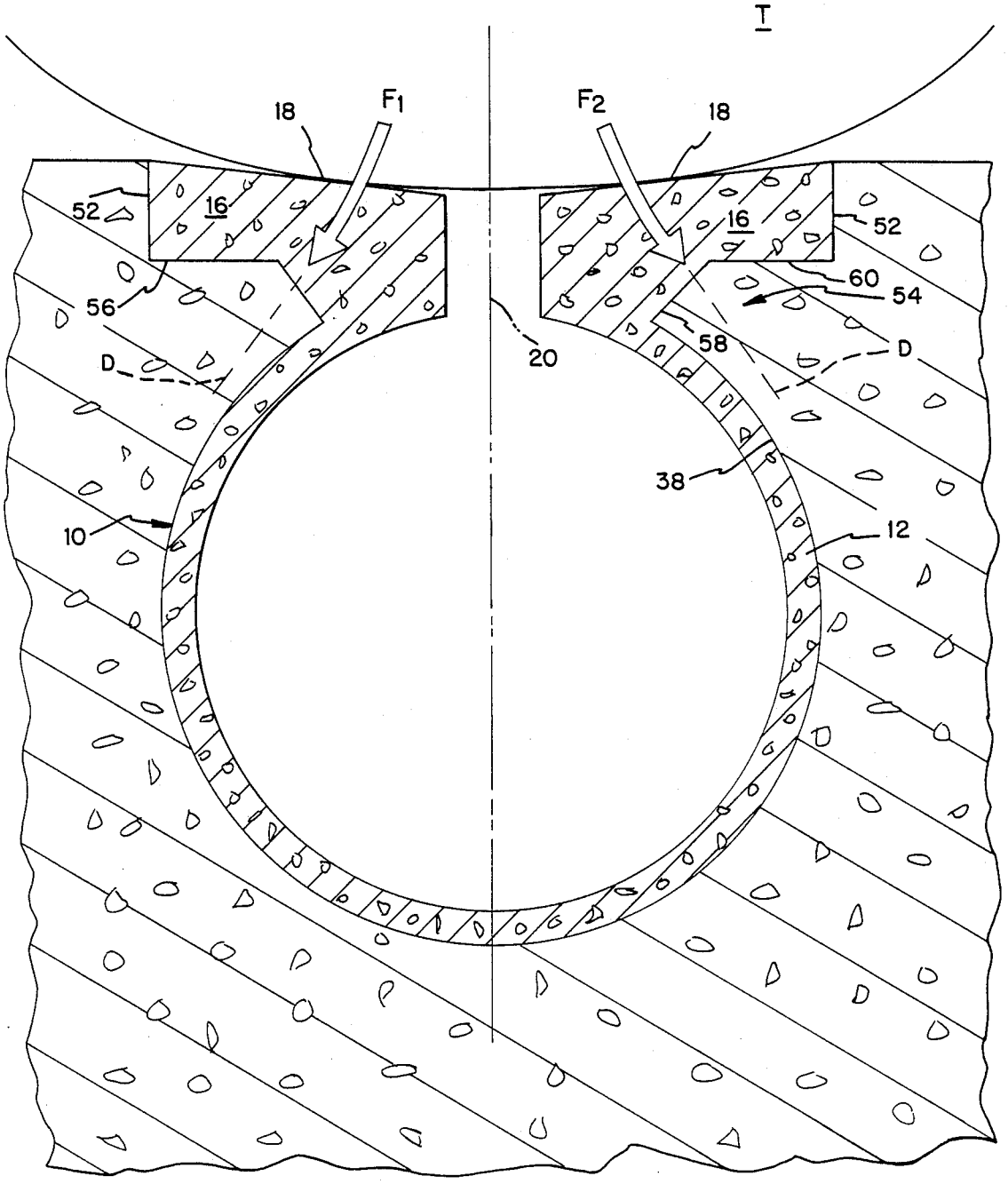
FIG. 5 illustrates a cross-sectional view of a preferred embodiment of the invention in functional position.

FIG. 5 shows a cross-sectional view of a conduit in use. The conduit 10 is encompassed by a different material 40 such as concrete which in most instances is less expensive than the material from which slotted conduit 10 is formed. The inner body section 12 has an outer exterior region 38 in contact with encompassing material 40. Towards the outer edges 52 of upper horizontal frame sections 16 recesses 54 are formed below the inclined upper surfaces 18 of the upper horizontal frame sections 16.

The recesses 54 assist in maximizing material economy and the strength of the slotted conduit when in use. As can be seen in FIG. 5, the material 40 fills in the recess in a manner which ensures a good distribution in downward forces and hence the slotted conduit 10 is free from excessive stress and strain which will help to increase its useful life. The concrete in recess 54 also assists in holding the channel securely in the ground.

Moreover, the recess is specifically shaped so as to ensure that a majority of the forces (i.e., F1 and F2) are directed into the encompassing material 40 and not into the conduit itself. The recesses 54, as shown in FIG. 5, include a first horizontal surface 56 which extends inwardly from a respective edge 52. Extending further inwardly and downwardly from the inner edge of the horizontal surface 56, is inclined surface 58. Preferably the incline is about 45° with such an incline also providing a stronger transition section from the inner body section to the upper horizontal frame section. The lowermost edge of surface 58 is integrally attached to the exterior surface 38 of the inner body section 12.

In FIG. 5 there is shown a portion of an automobile tire T travelling over the upper surface of slotted conduit 10. The forces created and the areas on the slotted conduit where they are greatest depend, in part, on the incline of the upper surface and the inflation of the tire. In a usual situation, due to the incline, the forces (F1 and F2, FIG. 5) will not be directed entirely downward. To ensure adequate strength of the conduit with a minimization in material use the inclined boundary wall 58 is positioned so as to direct a good deal of the vertical and transverse forces into the encompassing material 40 and not into the structure of the conduit. The direction of the forces exerted first on the conduit and then on the encompassing boundary material 40 are represented by the dashed lines D in FIG. 5.

The recesses 54 also act in the prevention of any rotation of the conduit. That is, the shape of overlying portions of the upper horizontal frame sections 16 and the positioning of the material 40 below these overlying portions 60 ensure that no rotational movement takes place.

To also assist in locking the slotted conduit in position, slanted lower recess edges 62 are provided on each of the lower longitudinal frame sections 42 and 46. The slanted recess 62 provide an increase in free area into which the material 40 flows. This arrangement thus promotes a secure locking feature and the ability to minimize the amount of material needed to form slotted conduit 10.

In a preferred method of manufacturing the slotted drain conduit 10, a homogeneous mixture of polymer and aggregate is poured into a wood or steel two-part mold by way of an extrusion process. The extrusion process involves a conventional polymer extrusion machine which is adapted to accommodate the high aggregate content. For example, adaptations which increase the strength and durability of the extrusion machine components especially in the nozzle area. Also, a liner material which is more wear resistant can be utilized in the area which comes in contact with the higher pressure polymer concrete. After the polymer concrete is poured into the mold, the concrete solidifies in a conventional curing process.

While the foregoing shows and describes what is considered to be applicant's invention, it should be understood that such changes in construction, design and materials as come within the appended claims may be resorted to if desired without departing from the spirit of the invention.

What is claimed is:

1. A drainage apparatus, comprising:

an open ended tubular conduit having formed therein a longitudinally extending channel and a longitudinally extending slot which opens into the channel;

said tubular conduit including an inner body section and an external frame structure integrally secured to the exterior of said inner body section, said frame structure including two upper horizontal frame sections each extending longitudinally along an upper portion of said inner body section and each having a first edge which defines the slot in said tubular conduit;

said tubular conduit having recesses formed therein which extend longitudinally along the length of said tubular conduit and are positioned to have a first recess boundary wall defined by a bottom surface of a respective one of said horizontal frame sections and a second recess boundary wall defined by a respective exterior portion of said inner body section.

2. A drainage apparatus as recited in claim- 1 wherein each of aid first recess boundary walls includes an essentially horizontal surface extending inwardly from an exterior edge of a respective one of said horizontal frame sections and a downwardly sloping surface which extends away from the innermost edge of said horizontal surface and comes in contact with a respective exterior portion of said inner body section.

3. A drainage apparatus as in claim 2 wherein said tubular conduit includes a first end and a second end and said external frame structure includes a female end frame section and a male end frame section, said female end frame section located at the first end of said tubular conduit and arranged so as to surround the periphery of said inner body section, said female end frame section having a bore formed therein which extends longitudinally into the first end of said tubular body and the surface of said female end frame section defining the bore being greater in cross-sectional free area than the cross-sectional free area of the surface defining the channel in said tubular conduit.

4. A drainage apparatus as in claim 3 wherein said male end frame section is located at the second end of said tubular conduit and is arranged so as to surround the periphery of said inner body section, said male end frame section including a male projection member with a notch formed therein, said projection member extending longitudinally away from the first end of said tubular conduit and having an inner and outer peripheral surface with the inner peripheral surface having a cross-sectional free area which is essentially equal to that of the surface defining said channel and the cross-sectional area of the outer peripheral surface being fittingly less than the cross-sectional free area of the surface defining the bore in said female end frame section.

5. A drainage apparatus as in claim 4 wherein said projection member has a keyhole formed therein and said female end frame section further including a tab formed thereon, the tab being positioned such that insertion of a tab into the keyhole of any projection member having the same dimension as said projection member, would result in the notch in the similarly shaped projection member being aligned with the slot in said tubular conduit.

6. A drainage apparatus as in claim 1 wherein said external frame structure further includes at least one rib member positioned between the ends of said tubular conduit, said rib member having a first end attached to one of said upper horizontal frame sections and a second end attached to the other of said upper horizontal frame sections.

7. A drainage apparatus as recited in claim 6 wherein said external frame structure further comprises a first lower longitudinal frame section and a second lower longitudinal frame section, said first lower longitudinal frame section having a first end integrally secured to a lower portion of said female end frame section and a second end positioned between an adjacent rib member and the first end of said first lower longitudinal frame section, said second lower longitudinal frame section having a first end integrally secured to a lower portion of said male end frame section and a second end positioned between an adjacent rib member and the first end of said second lower longitudinal frame section.

8. A drainage apparatus as recited in claim 7 wherein said second lower longitudinal frame section is formed with a reduced thickness, recessed area which is adapted to be removed so as to provide a transverse pipe insertion hole.

9. A drainage apparatus as recited in claim 1 wherein said slot has a width of 3/4 of an inch.

10. A drainage apparatus as recited in claim 1 wherein said tubular conduit is formed of a polymer concrete.

11. A drainage apparatus, comprising:

an open ended tubular conduit having formed therein a longitudinally extending channel and a longitudinally extending slot opening into said channel, said tubular conduit including an inner body section and an external frame structure integrally secured to the exterior of said inner body section, said external frame structure including a pair of upper horizontal frame sections each extending longitudinally along an upper portion of said inner body section and each extending transversely towards one another to form longitudinal slot therebetween, said external frame structure further comprising a first end frame section and a second end frame section, said first end frame section having formed therein a longitudinally extending bore which shares a common axis with the channel, and the cross-sectional free area of the surface of said first end section defining the bore being greater than that of the channel, said first end frame section also having formed thereon a tab positioned within the bore, said second end frame section including a projection member extending longitudinally away from said first end frame section, said projection member having a notch formed therein and a keyhole formed therein, said keyhole, tab and notch being positioned on their respective end frame sections such that insertion of a tab into the keyhole in a projection member dimensioned the same as said projection member results in the notch of the similarly dimensioned projection member being in alignment with the slot of said tubular conduit.

12. A drainage apparatus as recited in claim 11 wherein said slot has a width which is less than two inches.

13. A drainage apparatus as recited in claim 11 wherein said tubular conduit is formed of polymer concrete.

14. A drainage apparatus as recited in claim 11 wherein said external frame section further comprise at least one rib member positioned between the first and second ends of said tubular conduit, said at least one rib member extending about and attached to the external surface of said inner body section and said at least one rib member having one end attached to one of the upper horizontal frame sections.

15. A drainage apparatus as recited in claim 14 wherein said external frame section further comprises a first lower longitudinal frame section and a second lower longitudinal frame section, said first lower longitudinal frame section having a first end integrally secured to a lower portion of said first end frame section and a second end positioned a distance closer to the second end frame section, said second lower longitudinal frame section having one end integrally secured to the second end frame section and its other end positioned a distance closer to said first end frame section.

16. A drainage apparatus, comprising: an open ended tubular conduit having formed therein a longitudinally extending channel and a longitudinally extending slot which opens into the channel, said tubular conduit including an inner body section and an external frame structure integrally secured to the exterior of said inner body section, said frame structure including a first end frame section and a second end frame section each positioned at a respective end of said inner body section, said external frame structure further including first and second lower longitudinal frame sections, said first lower longitudinal frame section being positioned on a lower portion of said inner body section with a first end integrally secured to said first end frame section and a second end positioned a distance closer to the second end frame section, and said second lower longitudinal frame section being position on the lower portion of said inner body section with a first end integrally secured to said second end frame section and a second end positioned a distance closer to the first end frame section.

17. A drainage apparatus as recited in claim 16 wherein said external frame structure includes two upper horizontal frame sections integrally joined with said first and second end frame sections, said upper horizontal frame sections each extending longitudinally along an upper portion of said inner body section and each having an edge which defines the slot in said tubular body.

18. A drainage apparatus as recited in claim 17 wherein said external frame structure further includes at least one rib member which extends about the external surface of said inner body section, has a first end integrally connected to a first one of said upper horizontal frame sections, a second end integrally connected to second one of said upper horizontal frame sections and is positioned between said first and second end frame sections.

19. A drainage apparatus as recited in claim 16 wherein said second lower horizontal frame section is formed with a recessed area which is adapted to be removed so as to provide a transverse pipe section hole.

20. A drainage apparatus as recited in claim 16 wherein said tubular conduit is formed of a polymer concrete.

* * * * *